US009767780B1

(12) United States Patent
Asbury

(10) Patent No.: US 9,767,780 B1
(45) Date of Patent: Sep. 19, 2017

(54) PEDAL SOUND MODIFICATION DEVICE

(71) Applicant: Armorit Engineering, LC, Sarasota, FL (US)

(72) Inventor: Floyd A. Asbury, Sarasota, FL (US)

(73) Assignee: Armorit Engineering, LC, Sarasota, FL (US)

( * ) Notice: Subject to any disclaimer, the term of this patent is extended or adjusted under 35 U.S.C. 154(b) by 0 days.

(21) Appl. No.: 15/261,428

(22) Filed: Sep. 9, 2016

(51) Int. Cl.
*G10H 3/00* (2006.01)
*G10H 1/34* (2006.01)
*G10H 1/46* (2006.01)
*G10H 1/02* (2006.01)

(52) U.S. Cl.
CPC ..... *G10H 1/348* (2013.01); *G10H 1/02* (2013.01); *G10H 1/46* (2013.01)

(58) Field of Classification Search
USPC ..... 84/737
See application file for complete search history.

(56) References Cited

U.S. PATENT DOCUMENTS 2,986,953 A 6/1961 Armond et al.
3,530,224 A 9/1970 Plunkett et al.
3,558,793 A * 1/1971 Nakada ..... G10H 1/0553 84/600
3,894,445 A * 7/1975 Rowe ..... G05G 1/30 338/153
4,649,785 A 3/1987 Chapman
5,659,145 A * 8/1997 Weil ..... G10H 1/348 84/464 R
8,704,075 B2 4/2014 Gournis
8,859,877 B2 10/2014 Oba et al.
2014/0290469 A1* 10/2014 Michaud ..... G10H 1/0091 84/741
2015/0371622 A1* 12/2015 Beaty ..... G10H 1/46 84/633

* cited by examiner

*Primary Examiner* — Christopher Uhlir
(74) *Attorney, Agent, or Firm* — Frijouf, Rust & Pyle, P.A.

(57) ABSTRACT

A pedal sound modification device is disclosed for varying an electrical signal. The device includes a plate pivotably coupled to a base. A slide potentiometer is coupled to the base and has a slider arm slidably engaging a linear potentiometer. The linear potentiometer extends between proximal slide end and a distal slide end. A linkage rod is pivotably coupled to the plate and the slide potentiometer for displacing the slide arm relative to the linear potentiometer upon a pivoting displacement of the plate relative to the base. The plate contacts the base for defining a proximal slide arm stop and positions the slide arm immediately adjacent to the proximal slide end for preventing damage to the slide potentiometer. The plate contacts the base for defining a distal slide arm stop and positions the slide arm immediately adjacent to the distal slide end for preventing damage to the slide potentiometer.

5 Claims, 10 Drawing Sheets

PEDAL SOUND MODIFICATION DEVICE

BACKGROUND OF THE INVENTION

Field of the Invention

This invention relates to a pedal and more particularly to a pedal sound modification device.

Background of the Invention

Audio modifying pedals enable altering the audio output of a musical device. Predominantly, the audio modifying pedals have been utilized with electric guitars. However the audio modifying pedals may be also utilized with electronic keyboards, electric pianos, electric basses or other electrical musical devices. Preferably the audio modifying pedals are positioned on the floor wherein the operator positions pairs for her foot on the audio modifying pedal. The foot serves to pivot the pedal relative to the audio modifying pedal. Since the audio modifying pedal will receive a portion if not all the weight of the operator the audio modifying pedal is subjected to damage. Furthermore, the repetitive pivoting of the pedal may further damage the operation of the audio modifying pedal.

There have been many in the prior art who have attempted to solve these problems with varying degrees of success. None, however completely satisfies the requirements for a complete solution to the aforestated problem. The following U. S. Patents are attempts of the prior art to solve this problem.

U.S. Pat. No. 2,986,953 to Armond et al. discloses a pedal assembly comprising a treadle having a first pivot axis permitting up and down motion of an end thereof. The treadle also having a second pivot axis generally perpendicular to said first pivot axis permitting lateral movement of the end of the treadle. A longitudinal member is secured to the under side of the treadle at the second pivot axis moveable laterally with the treadle about the second pivot axis. The member extends from the second pivot axis a distance such that one end is located generally under the treadle end. An adjustable control component is on the longitudinal member, means connecting the component to the treadle end making the component adjustable subject to vertical motion of the treadle about the first pivot axis.

U.S. Pat. No. 3,530,224 to Plunkett et al. discloses a circuit means adapted to be inserted between a musical instrument and a speaker means. The instrument including tone generating means for delivering electric tone signals corresponding to musical sounds, and the speaker means serving to transduce the tone signals into musical tones. The circuit means being adapted to have applied thereto from the instrument, electric tone signals in a predetermined frequency range lying within the range of the electric tone signals delivered by the tone generating means for passing the electric tone signals delivered by the tone generating means for passing the electric tone signals from the tone generating means to the speaker. The circuit means including: network means for favoring the delivery of certain signal frequencies in a narrow frequency band within the predetermined frequency range from the tone generating means to the speaker means, and foot-operated control means physically separated from the instrument and readily controllable by the foot of the instrument player for continuously varying the narrow frequency band back and forth over the predetermined frequency range.

U.S. Pat. No. 4,649,785 to Chapman discloses an amplified musical instruments such as electric guitars, this method of extending the range of timbre variation available from a "wah" type of pedal controlled sound modification effect provides musicians with increased flexibility of expression by including within the controlling range of the foot pedal an unmodified "dry" condition in addition to the variable modified condition with the capability of blending smoothly back and forth between the two conditions.

U.S. Pat. No. 8,704,075 to Gournis discloses a guitar pickup assembly which would allow a guitar player to blend the sound of two or more pickups smoothly as the player desires via the use of a foot pedal. The guitar pickup assembly includes a guitar separately providing the output from a first pickup and a second pickup separately to an actuator, such as a foot pedal, wherein movement of the foot pedal from one position to another position alters the ratio of the signal from the first pickup and the second pickup.

U.S. Pat. No. 8,859,877 to Oba, et al. discloses an elongated lifting rail being displaceable to collectively pivot a plurality of damper levers. An actuator is provided beside or underneath the lifting rail for automatically displacing the lifting rail. The lifting rail is displaced, in response to driving of the actuator, to displace the damper levers so that the dampers are moved away from contact with sounding members. Further, a position sensor is provided for detecting a displaced position of the lifting rail, so that position data detected by the position sensor is used for operating position control and/or operating position recording of the dampers.

United States Patent Application 20140290469 to Michaud, et al. discloses an audio effect control pedal for musicians has, in one embodiment, a first input connection, a second input connection, a first output connection, a second output connection, and a mixing circuit). The mixing circuit inputs are connected to the first and second input connections, and the output of the mixing circuit is connected to the first output connection. The mixing circuit creates an output signal that is a combination of the signals present on the first and second input connections. A treadle is mechanically linked to a potentiometer (P1) that is part of the mixing circuit. Moving the treadle rotates the potentiometer and changes the proportion of signals from the first and second input connections. Other embodiments are described and shown.

Although the aforementioned prior art have contributed to the development of the art of audio modifying pedals none of these prior art patents have solved the needs of this art.

Therefore, it is an object of the present invention to provide an improved audio modifying pedal that may withstand the weight of the operator.

Another object of this invention is to provide an audio modifying pedal that may receive repetitive pivoting of the pedal without failing.

Another object of this invention is to provide an audio modifying pedal tray that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a pedal sound modification device including a base having a first pivot support between a proximal base side and a distal base side. A base proximal stop is in the proximal base side. A base distal stop is in the distal base side. A plate has a pivot bracket between a between a proximal plate side and a distal plate side. A plate proximal stop is in the proximal plate side. A plate distal stop is in the distal plate side. A pivot couples the pivot support and the pivot bracket for pivoting the plate relative to the base. An electrical circuit is coupled to the base for receiving the electrical signal. An electrical input connection is electrically linked to the electrical circuit for inputting the electrical signal into the electrical circuit. An electrical output connection is electrically linked to the electrical circuit for outputting the electrical signal from the electrical circuit. A slide potentiometer is coupled to the base and has a slider arm slidably engages a linear potentiometer for varying the electrical signal. The linear potentiometer extends between proximal slide end and a distal slide end. The slide arm slidably engages the linear potentiometer between the proximal slide end and the distal slide end. A second pivot support is coupled to the plate. A potentiometer pivot support is coupled to the slide arm. A linkage rod is pivotably coupled to the second pivot support and the potentiometer pivot support for displacing the slide arm relative to the linear potentiometer upon a pivoting displacement of the plate relative to the base. The plate proximal stop contacts the base proximal stop for defining a proximal slide arm stop and positioning the slide arm immediately adjacent to the distal slide end for preventing damage to the slide potentiometer. The plate distal stop contacts the base distal stop for defining a distal slide arm stop and positioning the slide arm immediately adjacent to the proximal slide end for preventing damage to the slide potentiometer.

In a more specific embodiment of the invention, a mounting bracket is slidably coupled to the base. The bracket is coupled to the slide potentiometer. The slide potentiometer is displaced relative to the base by the bracket for adjusting the proximal slide end and the distal slide end and preventing damage to the slide potentiometer.

In a more specific embodiment of the invention, the base includes a base plate, a primary vertical wall and a secondary vertical wall for defining a general U-shape member. The electrical circuit and the slide potentiometer coupled within the generally U-shape member.

In a more specific embodiment of the invention, the base proximal stop includes a primary base proximal stop and a secondary base proximal stop in the general U-shape member. The base distal stop includes a primary base distal stop and a secondary base distal stop in the general U-shape member.

In an another more specific embodiment of the invention, the primary base proximal stop includes a primary proximal end declining sloping edge in the primary vertical wall for positioning the plate in an inclined orientation relative to the base. The secondary base proximal stop includes a secondary proximal end declining sloping edge in the secondary vertical wall for positioning the plate in an inclined orientation relative to the base. The primary base distal stop includes a primary distal end declining sloping edge in the primary vertical wall for positioning the plate in a declined orientation relative to the base. The secondary base distal stop includes a secondary distal end declining sloping edge in the secondary vertical wall for positioning the plate in a declined orientation relative to the base.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
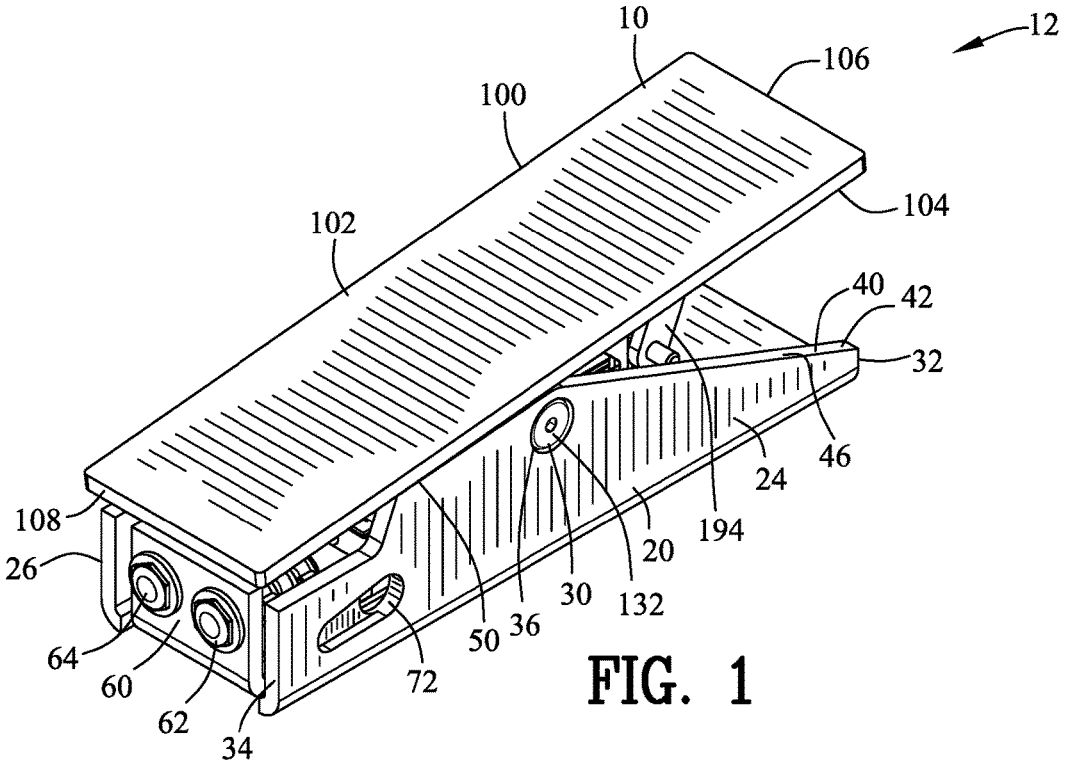
FIG. 1 is an upper front isometric view of a pedal sound modification device in a distal slide arm stop incorporating the present invention.
Figure 2:
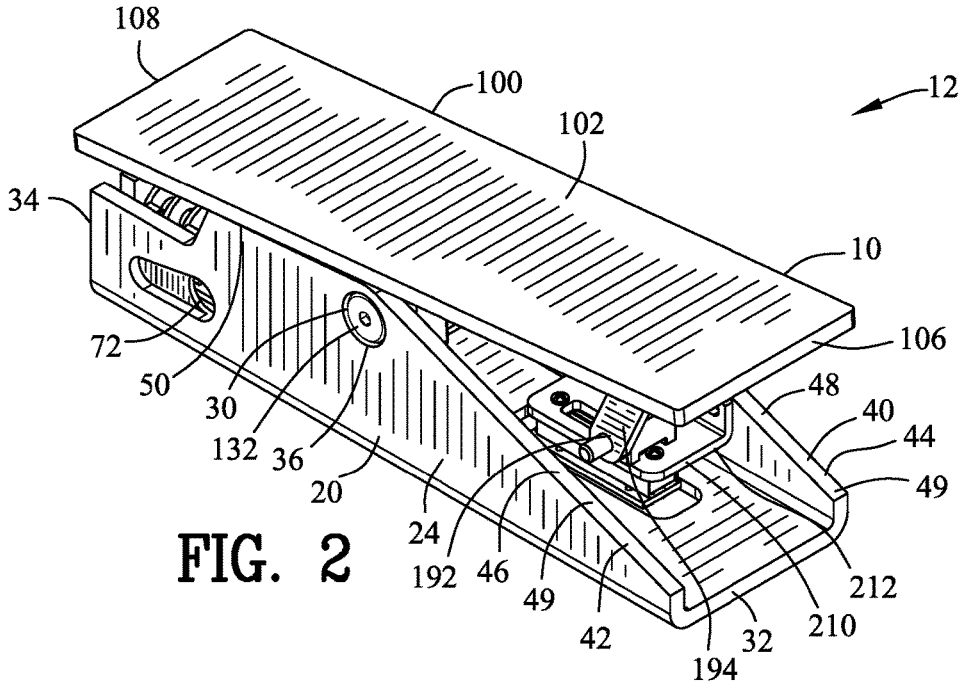
FIG. 2 is an upper rear isometric view of FIG. 1.
Figure 3:
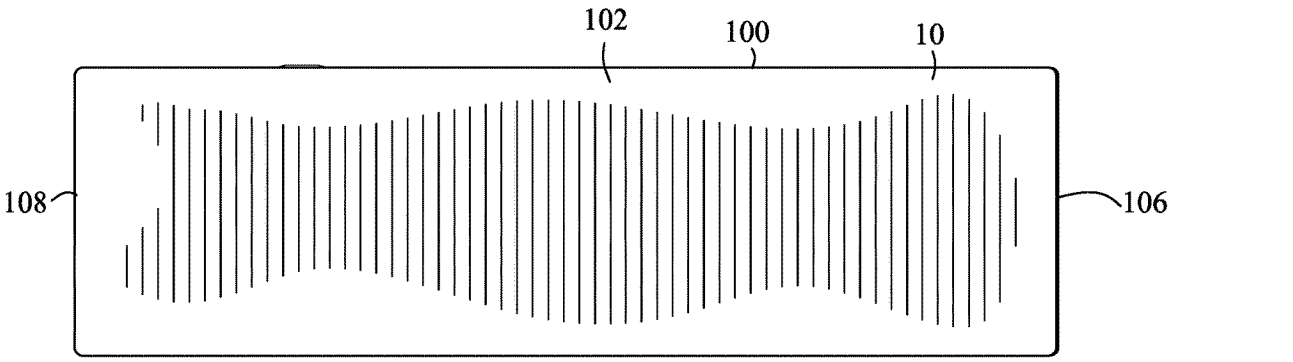
FIG. 3 is a top view of FIG. 1.
Figure 4:
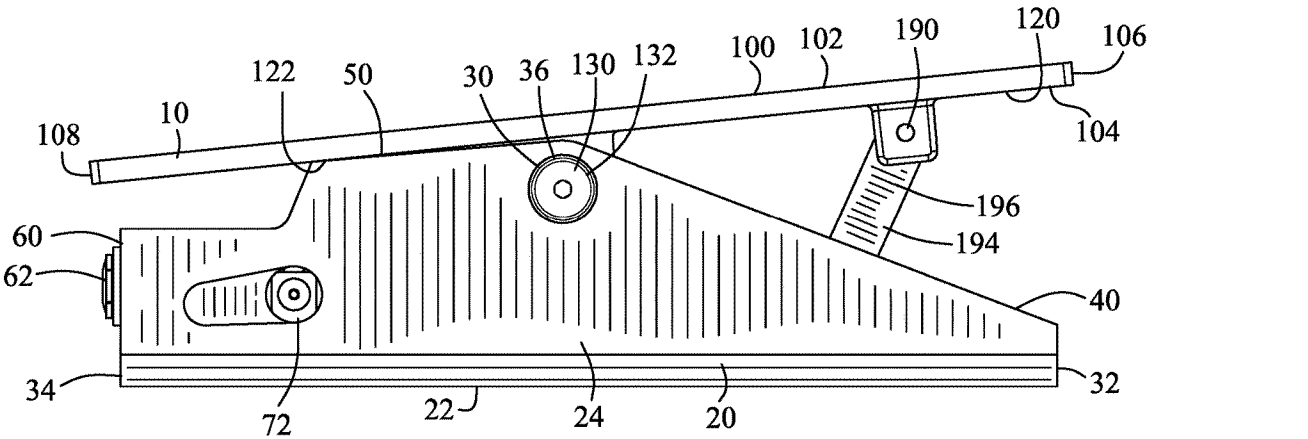
FIG. 4 is a front view of FIG. 3.
Figure 5:
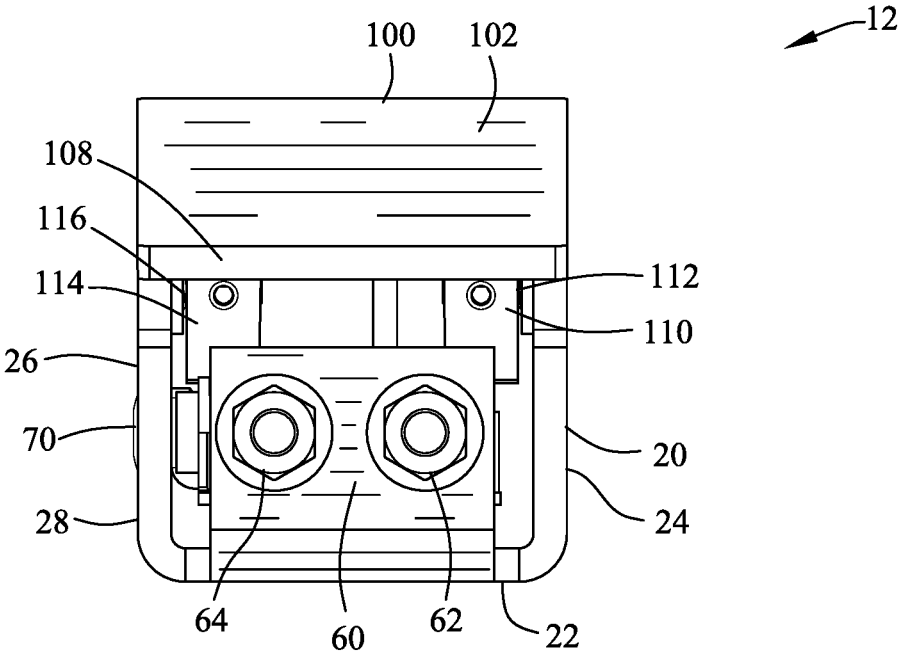
FIG. 5 is a front view of FIG. 1.
Figure 6:
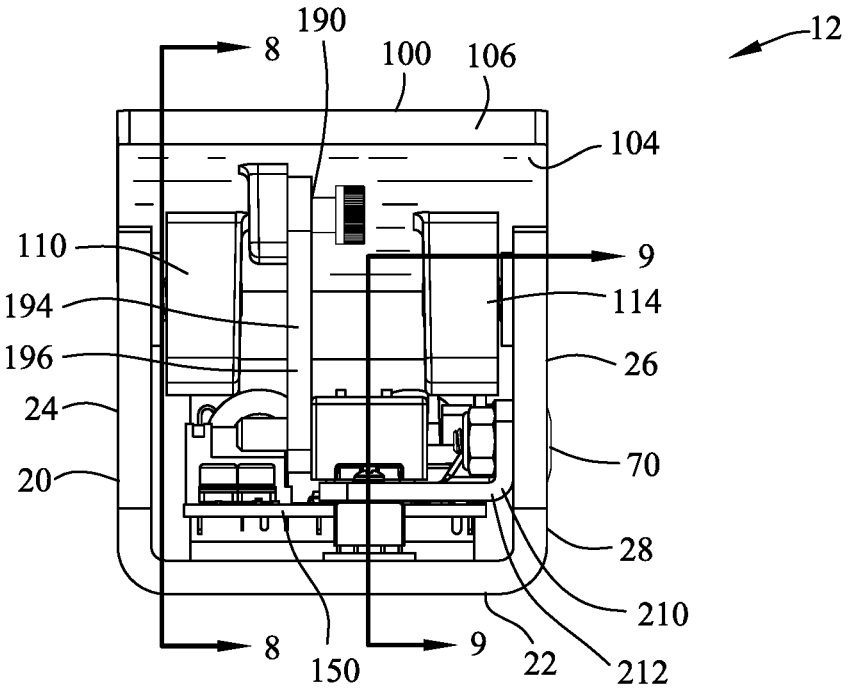
FIG. 6 is a rear view of FIG. 1.
Figure 7:
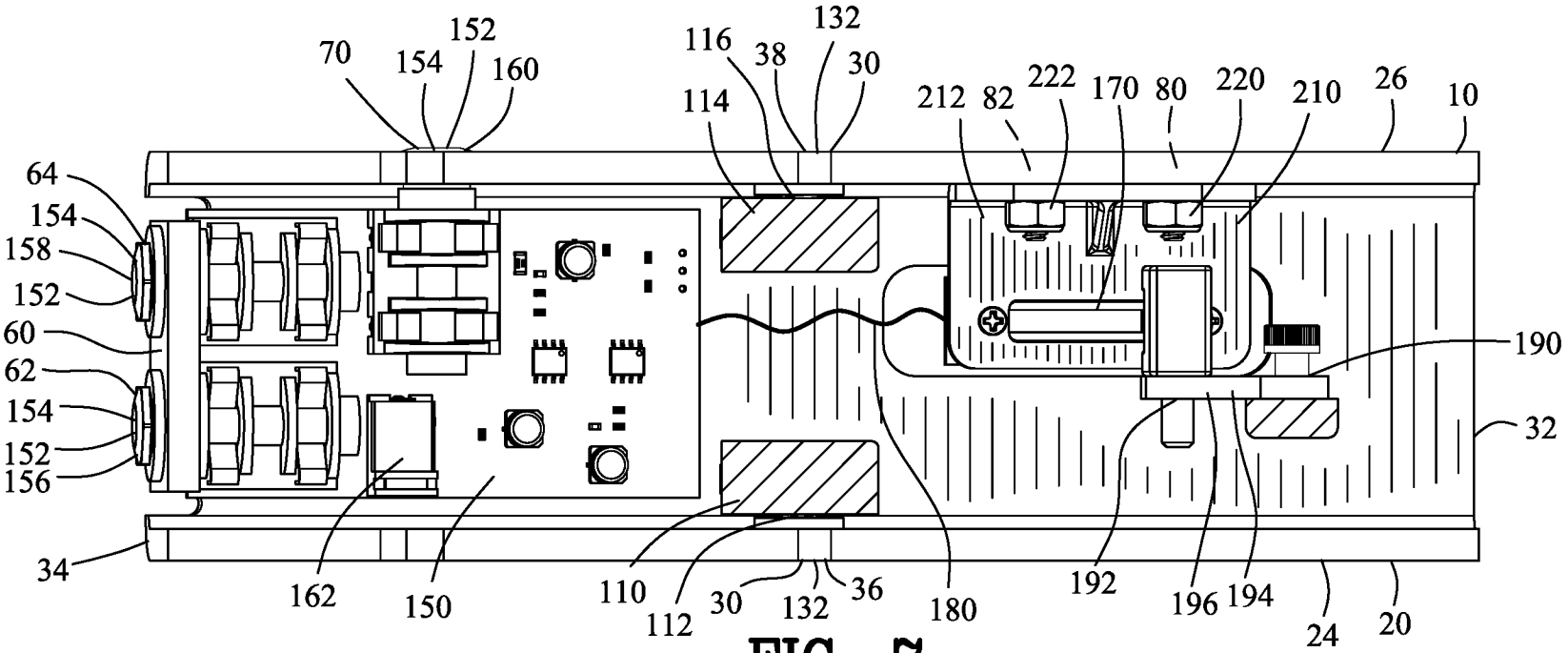
FIG. 7 is a sectional view along line 7-7 in FIG. 4.
Figure 8:
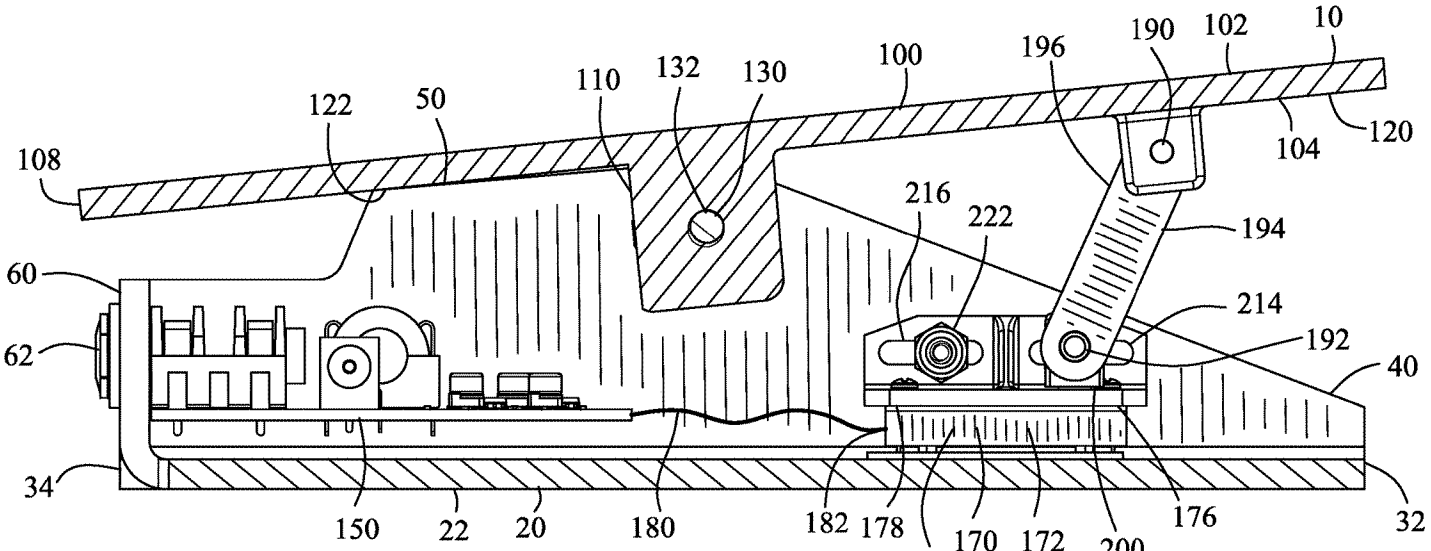
FIG. 8 is a sectional view along line 8-8 in FIG. 6.
Figure 9:
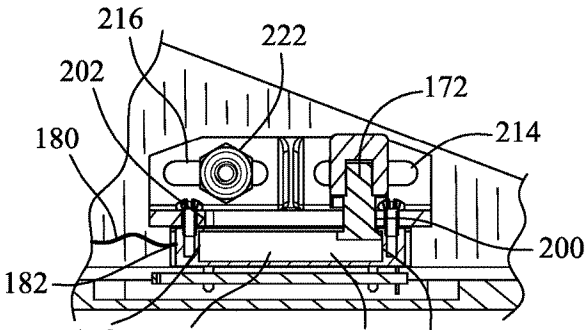
FIG. 9 is a sectional view along line 9-9 in FIG. 6.
Figure 10:
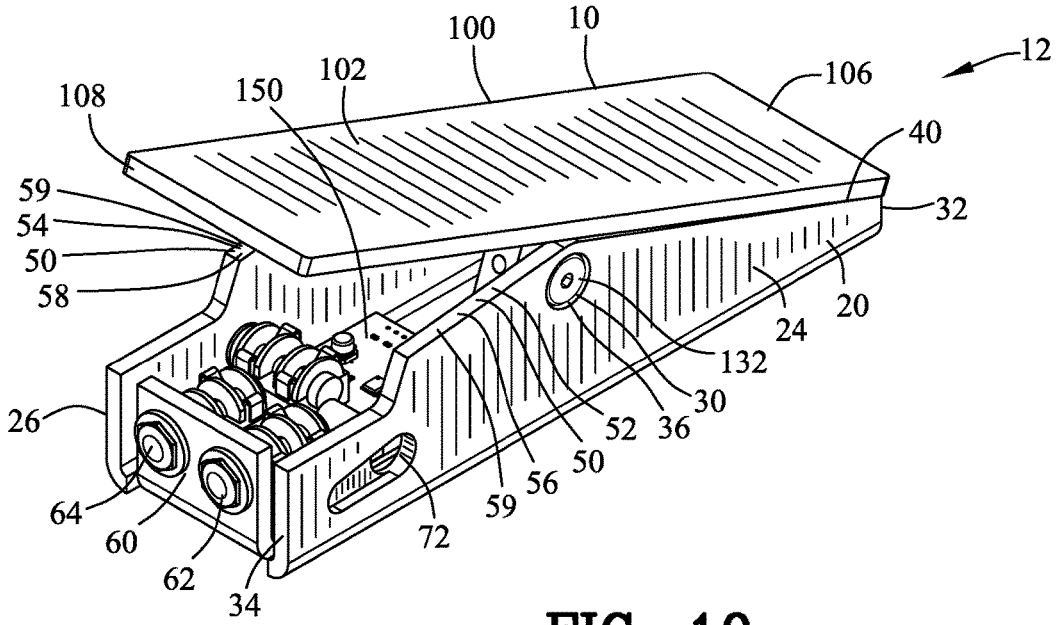
FIG. 10 is an upper front isometric view of the pedal sound modification device in a proximal slide arm stop incorporating the present invention.
Figure 11:
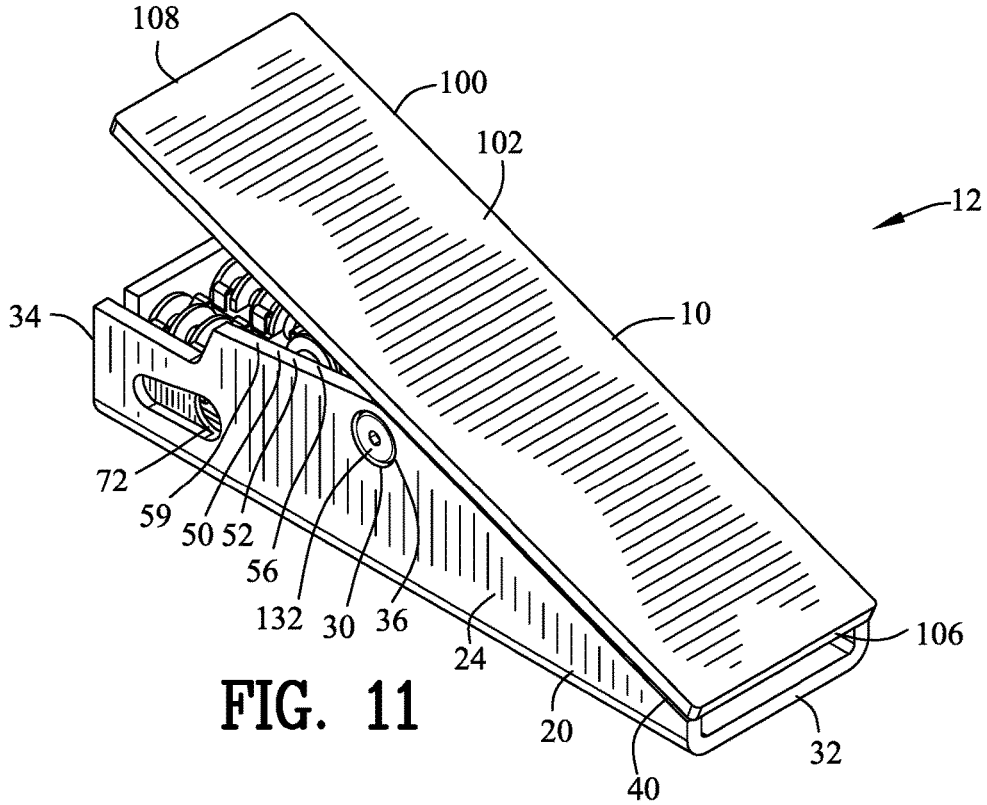
FIG. 11 is an upper rear isometric view of FIG. 10.
Figure 12:
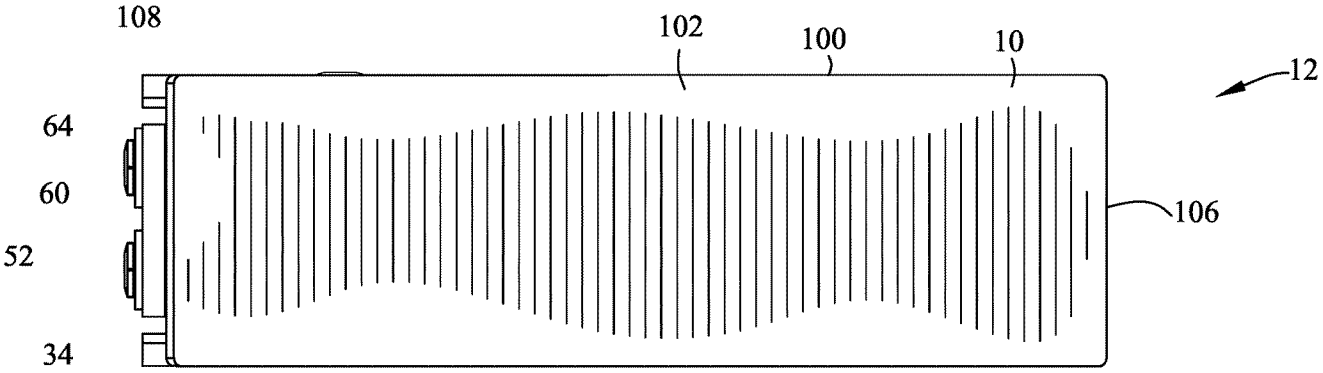
FIG. 12 is a top view of FIG. 10.
Figure 13:
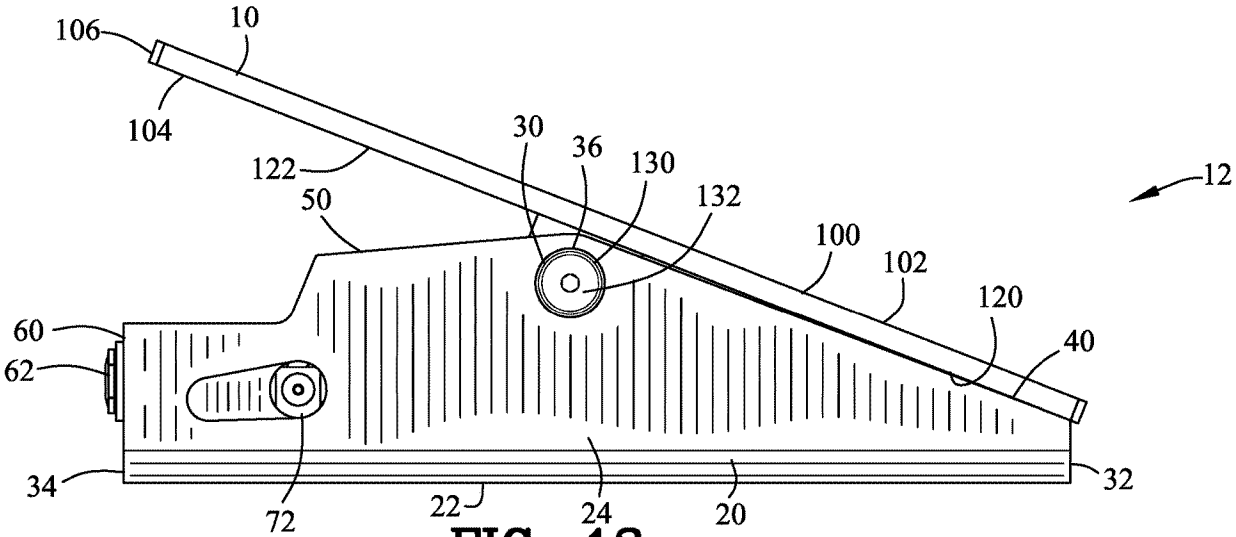
FIG. 13 is a front view of FIG. 12.
Figure 14:
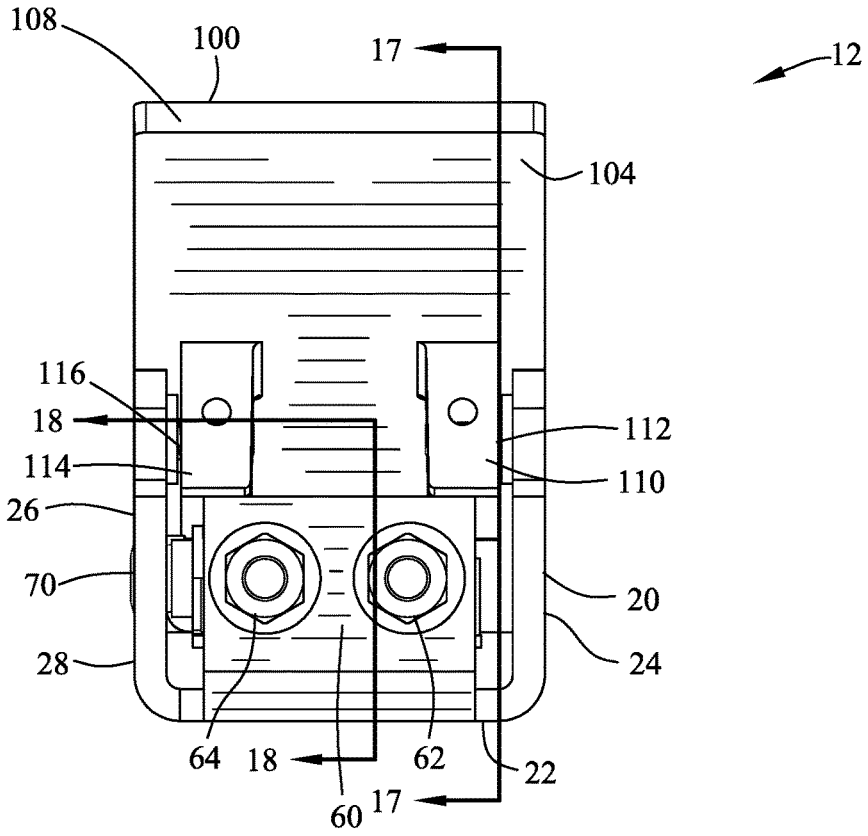
FIG. 14 is a front view of FIG. 10.
Figure 15:
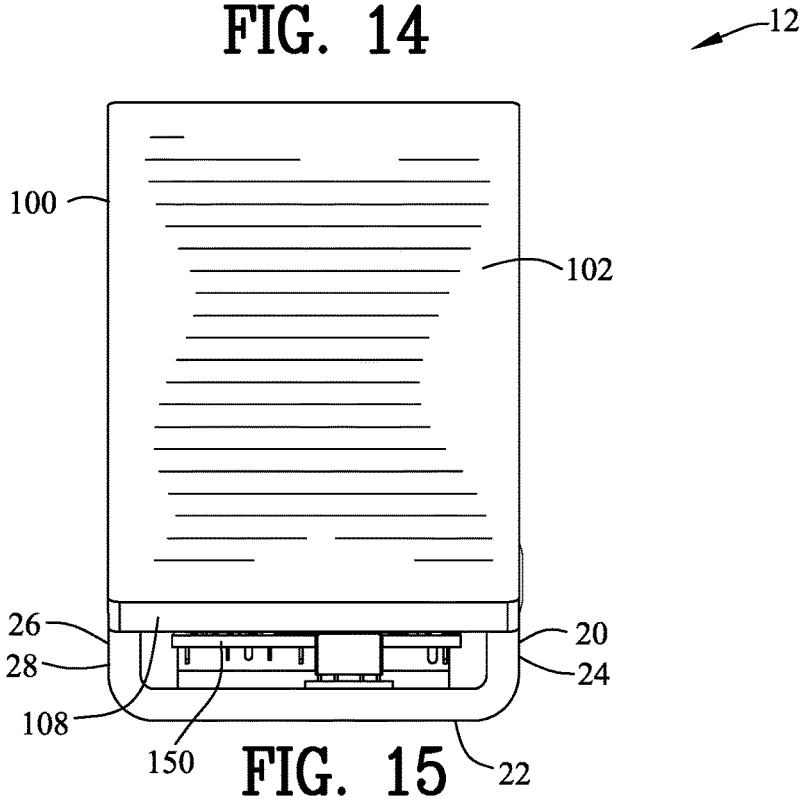
FIG. 15 is a rear view of FIG. 10.
Figure 16:
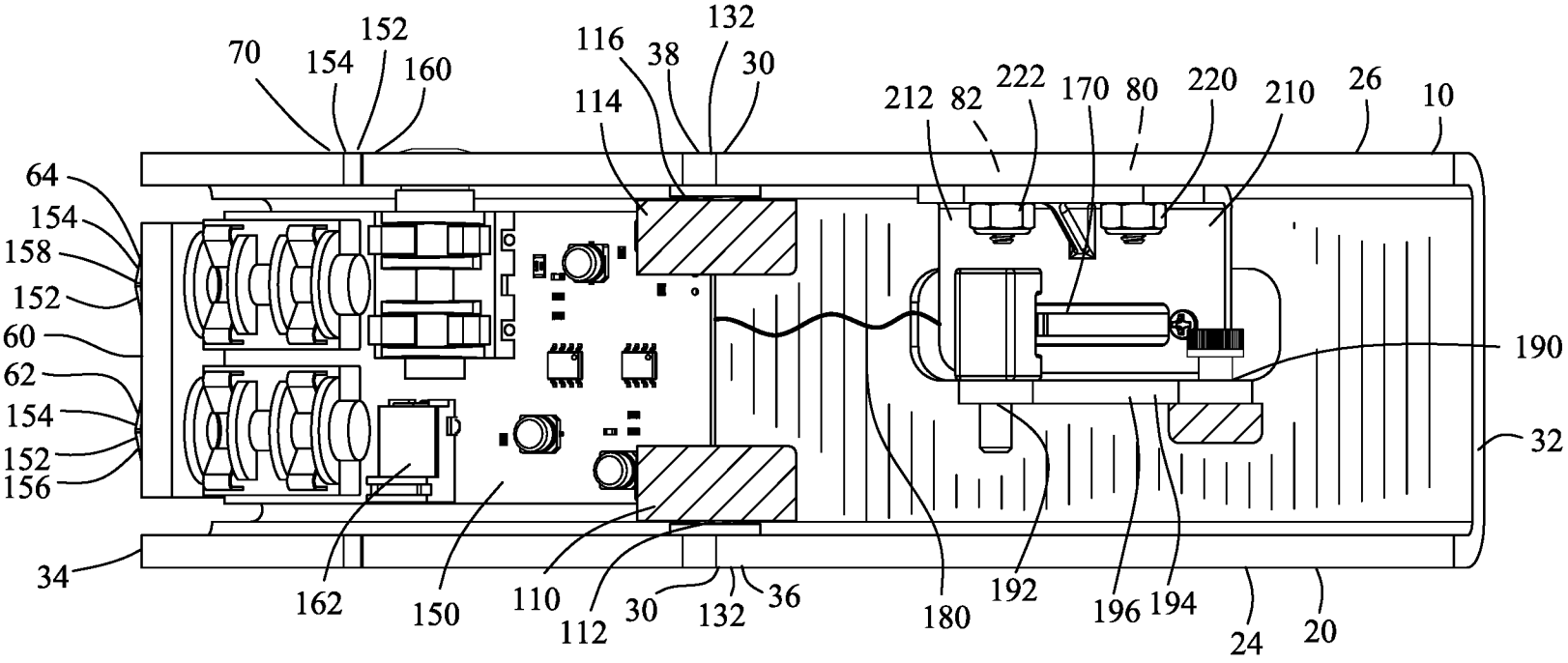
FIG. 16 is a sectional view along line 16-16 in FIG. 13.
Figure 17:
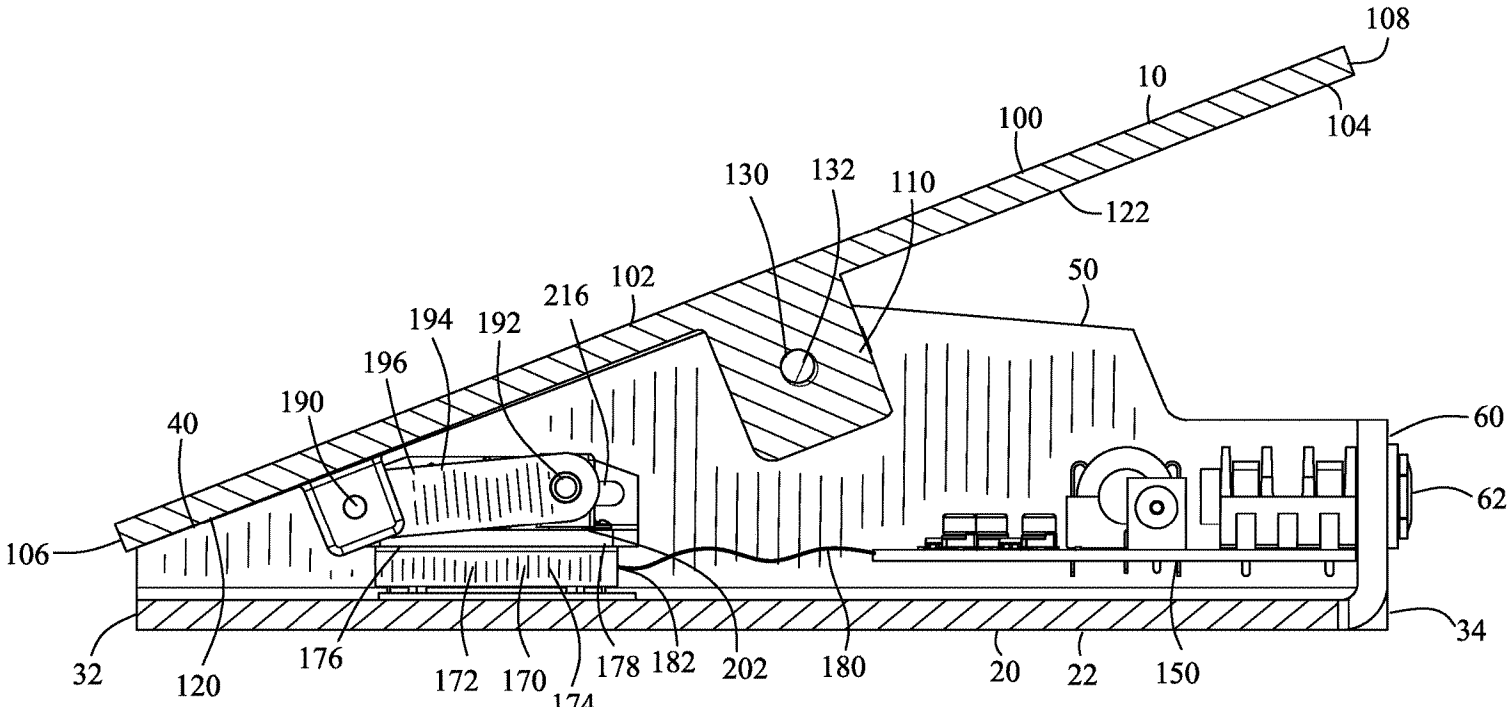
FIG. 17 is a sectional view along line 17-17 in FIG. 14.
Figure 18:
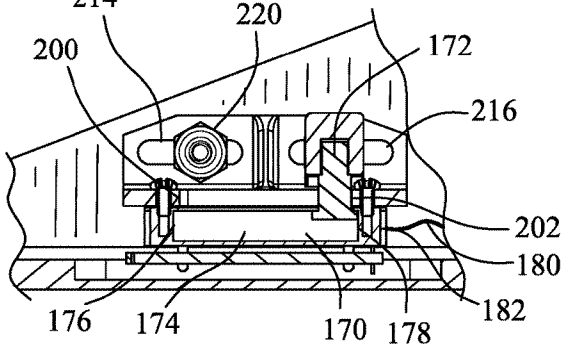
FIG. 18 is a sectional view along line 18-18 in FIG. 14.

FIGS. 1-18 illustrate a pedal sound modification device 10 for varying an electrical signal 12. Preferably, the electrical signal 12 is from a musical instrument such as an electric guitar, acoustic guitar, violin, or other musical instruments. The pedal sound modification device 10 may be used as a volume control, reverberation control or other sound modification control. The pedal sound modification device 10 may be active (dual buffer) and passive. Preferably, the pedal sound modification device 10 is positioned on a surface wherein the foot of an individual is placed on top for facilitating operation.

The pedal sound modification device 10 includes a base 20 having a first pivot support 30 between a proximal base side 32 and a distal base side 34. A base proximal stop 40 is in the proximal base side 32. A base distal stop 50 is in the distal base side 34. A plate 100 has a pivot bracket 110 between a between a proximal plate side 106 and a distal plate side 108. The plate 100 further includes an upper surface 102 for engaging the foot of an individual and a lower surface 104. A plate proximal stop 120 is in the proximal plate side 106. A plate distal stop 122 is in the distal plate side 108. A pivot 130 couples the pivot support 30 and the pivot bracket 110 for pivoting the plate 100 relative to the base 20.

An electrical circuit 150 is coupled to the base 20 for receiving the electrical signal 12. An electrical input connection 152 is electrically linked to the electrical circuit 150 for inputting the electrical signal 12 into the electrical circuit 150. An electrical output connection 154 is electrically linked to the electrical circuit 150 for outputting the electrical signal 12 from the electrical circuit 150.

A slide potentiometer 170 is coupled to the base 20 and has a slider arm 172 slidably engages a linear potentiometer 174 for varying the electrical signal 12. The linear potentiometer 174 extends between proximal slide end 176 and a distal slide end 178. The slide arm 172 slidably engages the linear potentiometer 174 between the proximal slide end 176 and the distal slide end 178. The slide potentiometer 170 may include an audio certified slider pot 182. A flexible electrical wire 180 electrically couples the slide potentiometer 170 with the electrical circuit 150.

A second pivot support 190 is coupled to the plate 100. A potentiometer pivot support 192 is coupled to the slide arm 172. A linkage rod 194 is pivotably coupled to the second pivot support 190 and the potentiometer pivot support 192 for displacing the slide arm 172 relative to the linear potentiometer 174 upon a pivoting displacement of the plate 100 relative to the base 20. The combination of the second pivot support 190, the potentiometer pivot support 192 and the linkage rod 194 defines a direct drive linkage 196 between the base 20 and the plate 100 for increasing the reliability and longevity of the pedal sound ratification device 10.

As shown in FIGS. 10-18, the plate proximal stop 120 contacts the base proximal stop 40 for defining a proximal slide arm stop 200 and positioning the slide arm 172 immediately adjacent to the distal slide end 178 for preventing damage to the slide potentiometer 170. As shown in FIGS. 1-9, the plate distal stop 122 contacts the base distal stop 50 for defining a distal slide arm stop 202 and positioning the slide arm 172 immediately adjacent to the proximal slide end 176 for preventing damage to the slide potentiometer 170.

A mounting bracket 210 is slidably coupled to the base 20. Preferably the mounting bracket 210 defines a general L-shape 212. The bracket 210 is coupled to the slide potentiometer 170. The slide potentiometer 170 is displaced relative to the base 20 by the bracket 210 for adjusting the proximal slide end 176 and the distal slide end 178 and preventing damage to the slide potentiometer 170.

The base 20 includes a base plate 22, a primary vertical wall 24 and a secondary vertical wall 26 for defining a general U-shape member 28. The electrical circuit 150 and the slide potentiometer 170 are coupled within the generally U-shape member 28. The first pivot support 30 includes a primary pivot aperture 36 in the primary vertical wall 24 and a secondary pivot aperture 38 within the secondary vertical wall 26. The pivot bracket 110 includes a pivot bracket aperture 112. Preferably, the further includes a second pivot bracket 114 including a second pivot bracket aperture 116. A fastener 132 traverses the primary pivot aperture 36 and into the pivot bracket aperture 112. Furthermore, a fastener 132 traverses the secondary pivot aperture 38 and into the second pivot bracket aperture 116. The combination of the pivot bracket 110 and the second pivot bracket 114 provides a stable pivoting coupling between the base 20 and the plate 100.

The base 20 may further include a distal front wall 60 having a first plug aperture 62 and a second plug aperture 64. The first plug aperture 62 may receive a first plug receptacle 156. Similarly the second plug aperture 64 may receive a second plug receptacle 158. The primary vertical wall 24 may include a third plug aperture 70 for receiving a third plug receptacle 160. Furthermore, the secondary vertical wall 26 may include a switch wall aperture 72 for accessing an electrical switch 162 that is mounted on the electrical circuit board 150. The first plug receptacle 156, the second plug receptacle 158 and the third plug receptacle 160 receives a male audio electrical plug for electrically coupling the electrical circuit 152 other electrical components.

The base proximal stop 40 includes a primary base proximal stop 42 and a secondary base proximal stop 44 in the general U-shape member 28. The base distal stop 50 includes a primary base distal stop 52 and a secondary base distal stop 54 in the general U-shape member 28.

As shown in FIGS. 10-18, the primary base proximal stop 42 includes a primary proximal end declining sloping edge 46 in the primary vertical wall 24 for positioning the plate 100 in an inclined orientation 49 relative to the base 20. The secondary base proximal stop 44 includes a secondary proximal end declining sloping edge 48 in the secondary vertical wall 26 for positioning the plate 100 in an inclined orientation 49 relative to the base 20.

As shown in FIGS. 1-9, the primary base distal stop 52 includes a primary distal end declining sloping edge 56 in the primary vertical wall 24 for positioning the plate 100 in a declined orientation 59 relative to the base 20. The secondary base distal stop 54 includes a secondary distal end declining sloping edge 58 in the secondary vertical wall 26 for positioning the plate 100 in a declined orientation 59 relative to the base 20.

The base 20 includes a first mounting aperture 80 and a second mounting aperture 82. A first elongated groove 214 and a second elongated groove 216 are in the bracket mounting bracket 210. A first fastener 220 engages the first mounting aperture 80 and the first elongated groove 214. A second fastener 222 engages the second mounting aperture 82 and the second elongated groove 216. The first fastener 220 slides within the first elongated groove 214 and the second fastener 222 slides within the second elongated groove 216 for adjusting the proximal slide end 176 and the distal slide end 178 relative to the base 20 for preventing damage to the slide potentiometer 170.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A pedal sound modification device for varying an electrical signal, comprising:

a base having a first pivot support between a proximal base side and a distal base side;

a base proximal stop in said proximal base side;

a base distal stop in said distal base side;

a plate having a pivot bracket between proximal plate side and a distal plate side;

a plate proximal stop in said proximal plate side;

a plate distal stop in said distal plate side;

a pivot coupling said pivot support and said pivot bracket for pivoting said plate relative to said base;

an electrical circuit coupled to said base for receiving the electrical signal;

an electrical input connection electrically linked to said electrical circuit for inputting the electrical signal into said electrical circuit;

an electrical output connection electrically linked to said electrical circuit for outputting the electrical signal from said electrical circuit;

a slide potentiometer coupled to said base and having a slider arm slidably engaging a linear potentiometer for varying the electrical signal;

said linear potentiometer extending between proximal slide end and a distal slide end;

said slider arm slidably engaging said linear potentiometer between said proximal slide end and said distal slide end;

a second pivot support coupled to said plate;

a potentiometer pivot support coupled to said slider arm;

a linkage rod pivotably coupled to said second pivot support and said potentiometer pivot support for displacing said slider arm relative to said linear potentiometer upon a pivoting displacement of said plate relative to said base;

said plate proximal stop contacting said base proximal stop for defining a proximal slide arm stop and positioning said slider arm immediately adjacent to said distal slide end for preventing damage to said slide potentiometer;

said plate distal stop contacting said base distal stop for defining a distal slide arm stop and positioning said slider arm immediately adjacent to said proximal slide end for preventing damage to said slide potentiometer;

a mounting bracket slidably coupled to said base;

said mounting bracket coupled to said slide potentiometer; and said slide potentiometer displaced relative to said base by said mounting bracket for adjusting said proximal slide end and said distal slide end and preventing damage to said slide potentiometer.

2. A pedal sound modification device as set forth in claim 1, wherein said base includes a base plate, a primary vertical wall and a secondary vertical wall for defining a general U-shape member; and said electrical circuit and said slide potentiometer coupled within said generally U-shape member.

3. A pedal sound modification device as set forth in claim 2, wherein said base proximal stop includes a primary base proximal stop and a secondary base proximal stop in said general U-shape member; and said base distal stop includes a primary base distal stop and a secondary base distal stop in said general U-shape member.

4. A pedal sound modification device as set forth in claim 3, wherein said primary base proximal stop includes a primary proximal end declining sloping edge in said primary vertical wall for positioning said plate in an inclined orientation relative to said base;

said secondary base proximal stop includes a secondary proximal end declining sloping edge in said secondary vertical wall for positioning said plate in an inclined orientation relative to said base;

said primary base distal stop includes a primary distal end declining sloping edge in said primary vertical wall for positioning said plate in a declined orientation relative to said base; and said secondary base distal stop includes a secondary distal end declining sloping edge in said secondary vertical wall for positioning said plate in a declined orientation relative to said base.

5. A pedal sound modification device as set forth in claim 1, wherein said base includes a first mounting aperture and a second mounting aperture;

a first elongated groove and a second elongated groove in said mounting bracket;

a first fastener engaging said first mounting aperture and said first elongated groove;

a second fastener engaging said second mounting aperture and said second elongated groove; and said first fastener sliding within said first elongated groove and said second fastener sliding within said second elongated groove for adjusting said proximal slide end and said distal slide end relative to said base for preventing damage to said slide potentiometer.

* * * * *